US006121411A

United States Patent [19]

Sartori et al.

[11] Patent Number: 6,121,411

[45] Date of Patent: Sep. 19, 2000

[54] PROCESS FOR DECREASED THE ACIDITY OF CRUDES USING CROSSLINKED POLYMERIC AMINES (LAW871)

[75] Inventors: Guido Sartori, Annandale; David William Savage, Lebanon; Bruce Henry Ballinger; David Craig Dalrymple, both of Bloomsbury, all of N.J.

[73] Assignee: Exxon Research and Engineering Company, Florham Park, N.J.

[21] Appl. No.: 09/369,569

[22] Filed: Aug. 6, 1999

Related U.S. Application Data

[63] Continuation-in-part of application No. 08/992,448, Dec. 17, 1997, abandoned.

[51] Int. Cl.[7] ..... C08F 6/14

[52] U.S. Cl. ..... 528/492; 528/491; 528/502 A; 528/502 D; 166/270; 166/274; 166/275; 166/300; 166/305 R

[58] Field of Search ..... 528/492, 491, 528/502 A, 502 D; 166/270, 274, 275, 300, 305 R

[56] References Cited

U.S. PATENT DOCUMENTS

| | | | |
|---|---|---|---|
| 2,068,979 | 1/1937 | Fisher | 196/35 |
| 2,770,580 | 11/1956 | Honeycutt et al. | 196/36 |
| 2,789,081 | 4/1957 | Mills | 196/36 |
| 2,795,532 | 6/1957 | Honeycutt | 196/36 |
| 3,318,809 | 5/1967 | Bray | 252/33 |
| 3,806,437 | 4/1974 | Franse et al. | 204/190 |
| 3,847,774 | 11/1974 | Jarrell | 204/190 |
| 3,994,344 | 11/1976 | Friedman | 166/270 |
| 4,033,860 | 7/1977 | Carlson | 208/206 |
| 4,163,728 | 8/1979 | Cheng et al. | 252/18 |
| 4,164,472 | 8/1979 | Cheng et al. | 508/460 |
| 4,179,383 | 12/1979 | Cheng et al. | 252/25 |
| 4,199,440 | 4/1980 | Verachtert | 208/230 |
| 4,226,739 | 10/1980 | Cheng et al. | 252/389 R |
| 4,300,995 | 11/1981 | Liotta | 208/8 LE |
| 4,647,366 | 3/1987 | Edmondson | 206/47 |
| 5,011,579 | 4/1991 | Davis | 203/37 |
| 5,182,013 | 1/1993 | Petersen et al. | 208/348 |
| 5,643,439 | 7/1997 | Sartori et al. | 208/47 |
| 5,683,626 | 11/1997 | Sartori et al. | 252/389.62 |

FOREIGN PATENT DOCUMENTS

| | | |
|---|---|---|
| 1786060A1 | 7/1993 | U.S.S.R. . |
| WO97/08270 | 6/1997 | WIPO . |
| WO97/08271 | 6/1997 | WIPO . |
| WO97/08275 | 6/1997 | WIPO . |

OTHER PUBLICATIONS

Chemical Abstracts, 72, 113446 (abstract only). (1968).

Camp et al, Neutralization as a Means of Controlling Corrosion of Refinery Equipment, National Association of Corrosion Engineers, 5th Annual Conference, Cincinnati, Ohio (Apr. 11–14), pp. 39–44 (1950).

Kalichevsky et al, Petroleum Refining With Chemicals, Elsevier Publishing Company, Chapter 4, pp. 136–183 (1956).

Mustafaev et al, Preparation of detergent and anticorrosion additives for lubricating oils from high–molecular–weight naphthenic acids (Oct. 20, 1997), SciFinder Abstract.

*Primary Examiner*—Duc Truong
*Attorney, Agent, or Firm*—Linda M. Scuorzo

[57] ABSTRACT

The invention relates to processes for treating acidic crudes or fractions thereof to reduce or eliminate their acidity by addition of effective amounts of crosslinked polymeric amines. The process has utility for crude processing.

9 Claims, No Drawings

PROCESS FOR DECREASED THE ACIDITY OF CRUDES USING CROSSLINKED POLYMERIC AMINES (LAW871)

This application is a Continuation-In-Part under 35 U.S.C. 1.53(b) of U.S. Ser. No. 08/992,448 filed Dec. 17, 1997, now abandoned.

FIELD OF THE INVENTION

The present invention relates to a process for decreasing the acidity and corrosivity of crudes and crude fractions containing petroleum acids.

BACKGROUND OF THE INVENTION

Many petroleum crudes with high organic acid content, such as whole crude oils containing naphthenic acids, are corrosive to the equipment used to extract, transport and process the crude, such as pipestills and transfer lines.

Efforts to minimize naphthenic acid corrosion have included a number of approaches. Examples of such technologies include use of oil soluble reaction products of an alkynediol and a polyalkene polyamine (U.S. Pat. No. 4,647,366), and treatment of a liquid hydrocarbon with a dilute aqueous alkaline solution, specifically, dilute aqueous NaOH or KOH (U.S. Pat. No. 4,199,440). U.S. Pat. No. 4,199,440 notes, however, that the use of aqueous NaOH or KOH solutions that contain higher concentrations of the base form emulsions with the oil, necessitating use of only dilute aqueous base solutions. U.S. Pat. No. 4,300,995 discloses the treatment of carbonous materials particularly coal and its products such as heavy oils, vacuum gas oil, and petroleum residua, having acidic functionalities, with a quaternary base such as tetramethylammonium hydroxide in a liquid (alcohol or water). Additional processes using bases such aqueous alkali hydroxide solutions include those disclosed in Kalichevsky and Kobe, *Petroleum Refining With Chemicals,* (1956) Ch. 4, and U.S. Pat. Nos. 3,806,437; 3,847,774; 4,033,860; 4,199,440 and 5,011,579. Publications WO 97/08270, WO 97/08271 and WO 97/08275 published Mar. 6, 1997, collectively disclose treatment with overbased detergents and Group IA and IIA oxides and hydroxides to decrease acidity and/or corrosion. Certain treatments have been practiced on mineral oil distillates and hydrocarbon oils (e.g., with lime, molten NaOH or KOH, certain highly porous calcined salts of carboxylic acids suspended on carrier media). Whole crude oils were not treated.

U.S. Pat. Nos. 2,795,532 and 2,770,580 (Honeycutt) disclose processes in which "heavy mineral oil fractions" and "petroleum vapors", respectively are treated, by contacting "flashed vapors" with "liquid alkaline material" containing, inter alia, alkali metal hydroxides and "liquid oil" using mixture of molten NaOH and KOH as the preferred treating agent, with "other alkaline materials, e.g., lime, also employed in minor amounts." The treatment of whole crudes or fractions boiling at 1050 plus ° F. ($565^{+}$° C.) is not disclosed; only vapors and condensed vapors of the 1050 minus ° F. ($565^{-}$° C.) fractions, that is, fractions that are vaporizable at the conditions disclosed in '532 are treated. Since naphthenic acids are distributed through all crude fractions (many of which are not vaporizable) and since crudes differ widely in naphthenic acid content the '532 patent does not provide an expectation that one would be able to successfully treat a broad slate of crudes of a variety of boiling points or to use bases other than NaOH and KOH.

U.S. Pat. No. 2,068,979 discloses a method for preventing corrosion in a petroleum still by adding calcium naphthenate to petroleum to react with and scavenge strong free acids such as hydrochloric and sulfuric acids to prevent corrosion in distillation units. The patent makes no claims with respect to naphthenic acids, which would have been formed when the strong acids were converted to salts. Patents have disclosed, inter alia, the addition or formation of calcium carbonate (Cheng et al, U.S. Pat. No. 4,164,472) or magnesium oxide (Cheng et al, U.S. Pat. Nos. 4,163,728 and 4,179,383, and 4,226,739) dispersions as corrosion inhibitors in fuel products and lubricating oil products, but not in whole or topped crude oil. Similarly, Mustafaev et al. (Sb. Tr. Azerb. Inst, Neft. Khim. (1971) 64-6) reported on the improved detergency and anticorrosive properties of calcium, barium, and zinc hydroxide additives in lubricating oils. Calcium hydroxide (Kessick, Canadian Patent 1,249,760) has been used to aid in separation of water from heavy crude oil wastes. U.S. Pat. No. 3,994,344 (Friedman) discloses the use of low molecular weight polyethylenimine to treat crudes. However, the resulting polyamine with acid groups attached is dissolved in the oil.

There is a continuing need to develop methods for reducing the acidity and corrosivity of whole crudes and fractions thereof, particularly residua and other $650^{+}$° F. ($343^{+}$° C.) fractions. Applicants' invention addresses these needs.

SUMMARY OF THE INVENTION

The present invention provides for a method for decreasing the acidity of an acidic crude oil by contacting a starting acid-containing crude oil with an effective amount of a crosslinked polymeric amine to produce a treated crude oil having a decreased acid content and a crosslinked polymeric amine having acid groups attached thereto. The crosslinked polymeric amine with acid molecules attached to it, which is insoluble in the crude, can be isolated from the crude, e.g., by filtration or centrifugation, and regenerated by displacing the acids.

The present invention may suitably comprise, consist or consist essentially of the elements disclosed and may be practiced in the absence of an element not disclosed.

DETAILED DESCRIPTION OF THE INVENTION

Some whole crude oils contain organic acids such as carboxylic acids that contribute to corrosion or fouling of refinery equipment. These organic acids generally fall within the category of naphthenic and other organic acids. Naphthenic acid is a generic term used to identify a mixture of organic acids present in petroleum stocks. Naphthenic acids can cause corrosion at temperatures ranging from about 65° C. (150° F.) to 420° C. (790° F.). Naphthenic acids are distributed through a wide range of boiling points (i.e., fractions) in acid containing crudes. The present invention provides a method for broadly removing such acids, and most desirably, from heavier (higher boiling point) and liquid fractions in which these acids are often concentrated. The naphthenic acids may be present either alone or in combination with other organic acids, such as phenols.

Whole crude oils are very complex mixtures in which a large number of competing reactions may occur. Thus, the potential for successful application of a particular treatment or process is not necessarily predictable from the success of other treatments or processes.

The present invention may be used in applications in which a reduction in the acidity would be beneficial and in which oil-aqueous emulsion formation and large solvent volumes are not desirable. The decrease in acidity typically, is evidenced by a decrease in the neutralization number of the acidic crude or a decrease in intensity of the carboxyl band in the infrared spectrum at about 1708 $cm^{-1}$ of the treated (neutralized) crude.

The concentration of acid in the crude oil is typically expressed as an acid neutralization number or total acid number (TAN), which is the number of milligrams of KOH required to neutralize the acidity of one gram of oil. It may be determined according to ASTM D-664. Typically, the decrease in acid content may be determined by a decrease in the neutralization number or in the intensity of the carboxyl band in the infrared spectrum at about 1708 $cm^{-1}$. Crude oils with total acid numbers of about 1.0 mg KOH/g and lower are considered to be of moderate to low corrosivity. Crudes with a total acid number of 0.2 or less generally are considered to be of low corrosivity. Crudes with total acid numbers greater than 1.5 are considered corrosive.

The crudes that may be used are any naphthenic acid-containing crude oils that are liquid or liquifiable at the temperatures at which the present invention is carried out. Typically the crudes have TAN of 0.2 to 10 mg KOH/g. As used herein the term whole crudes means unrefined, undistilled crudes.

The contacting is typically carried out at a temperature from ambient temperature to 150° C., with narrower ranges suitably from about 20° C. to 150° C., preferably 30° C. to 150° C.

Corrosive, acidic crudes, i.e., those containing naphthenic acids alone or in combination with other organic acids such as phenols may be treated according to the present invention.

The acidic crudes are preferably whole crudes. However, acidic fractions of whole crudes such as topped crudes and other high boiling point fractions also may be treated. Thus, for example, 500° F. (260° C.) fractions, $650^{+\circ}$ F. ($343^{+\circ}$ C.) fractions, vacuum gas oils, and most desirably $1050^{+\circ}$ F. ($565^{+\circ}$ C.) fractions and topped crudes may be treated.

In the present invention the crude is contacted with an effective amount of a crosslinked polymeric amine. Typically, these are solid at starting reaction temperatures. Examples of suitable compounds include polyethylenimine, polyallylamine and polyethylene piperazine. Crosslinking may be carried out as known in the art such as by treatment with peroxides or irradiation and produces a molecule of high molecular weight. In instances in which the monomer has been polymerized by a free radical mechanism, copolymerization with a suitable amount of difunctional monomer (e.g., divinyl benzene) produces a crosslinked polymeric amine. Polyethyleneimine and polyallylamine also may be crosslinked by reaction with a dihalide, e.g., 1,2-dichloroethane or 1,5-dibromopentane. The material is typically added as a solid, which also may include a solid-in-liquid slurry, solid-in-water or solid-in-organic liquid slurry. Addition should be in a molar ratio effective to produce a neutralized or partially neutralized crude oil. Neutralization may be in whole or partial as desired and thus molar ratios of amine groups to acid groups can vary within broad ranges to effect the desired reaction. Typically from 0.1 to 20, more preferable 0.5 to 10, most preferably 1 to 5, may be used.

Some crudes themselves contain a sufficient amount of water, but typically water addition facilitates the reaction particularly if the crosslinked polymeric amine is dry.

After reaction with the acidic functionalities in the crude oil, the crosslinked polymeric amine with acids attached to it, which is insoluble in the crude, can be isolated from the crude, e.g., by filtration or centrifugation. This is unlike prior art processes using low molecular weight (e.g., less than 600) since these are soluble in the crude and cannot be separated from it. Then the crosslinked polymeric amine may be regenerated and the acids recovered. Regeneration may be accomplished by displacing the acids via treatment with carbon dioxide in a suitable dispersant such as an aromatic hydrocarbon or with ammomia. The regenerated crosslinked polymeric amine may be recovered and recycled to treat additional acid containing crudes.

The formation of a crude oil-aqueous (i.e., either water-in-oil or oil-in-water) emulsion tends to interfere with the efficient separation of the crude oil and water phases and thus with recovery of the treated crude oil. Emulsion formation is undesirable and a particular problem that is encountered during treatment of naphthenic acid-containing crudes with aqueous bases. An additional benefit of the treatment is the absence or substantial absence of emulsion formation.

Suitable polymeric amines may be purchased commercially or synthesized using known procedures. In solid form, they may be in the form of a powder or a composite, sized particle or supported on a refractory (ceramic) matrix.

Reaction times depend on the temperature and nature of the crude to be treated, its acid content, but typically may be carried out for from less than about 1 hour to about 20 hours to produce a product having a decrease in acid content.

The present invention may be demonstrated with reference to the following non-limiting examples.

EXAMPLE 1

Crosslinking Polyallylamine

The reaction apparatus was a stirred vessel, equipped with a reflux condenser and having a capacity of 1 liter. 60 ml of water and 33.7 g of polyallylamine hydrochloride were put into the reactor and stirred until the polymer was completely dissolved. 14.4 g of solid sodium hydroxide were added slowly. 240 ml of n-octane and 600 mg of surfactant (Span 65) were added, followed by 22.6 g of 1,2-dibromoethane.

The mixture was stirred at 97° C. for 24 hours. The polymer was separated, treated with 5% aqueous NaOH, until $AgNO_3$ test showed no $Cl^-$. Then it was washed with water until neutral, dried in vacuo and extracted with methanol in Soxhlet until no more polymer was extracted. Then it was dried in vacuo and weighed 20 g.

EXAMPLE 2

Neutralization of Acid Crude

The reaction apparatus was a stirred vessel equipped with a reflux condenser and having a capacity of 250 ml. 50.0 g of Bolobo 2/4 crude, having an acid number of 7.3 mg KOH/g, measured by infrared, were put into the reactor. 4.3 g of crosslinked polyallylamine, prepared according to Example 1, were added. The temperature was brought to 100° C. and the mixture was stirred for 5–6 hours. Infrared examination showed no reaction. Another 4.3 g of crosslinked polyallylamine were added and the mass was stirred at 100° C. for 24 hours. Infrared examination showed no reaction.

37.5 g of the above reaction mixture were put into an identical reactor and 1.9 g of water were added. Neutralization occurred rapidly. Infrared examination showed that the band at 1708 $cm^{-1}$, due to carboxylic acids, decreased as compared to untreated Bolobo 2/4. A small sample of the liquid was centrifuged to separate solids from it. Titration of the liquid with KOH according to ASTM D-664 gave a total acid number of 1.2 mg KOH/g. Untreated Bolobo 2/4 had a total acid number of 7.3 mg KOH/g. Therefore, treatment with polyallylamine had removed 83% of the naphthenic acids.

The infrared spectra of the untreated and treated crude were identical in the region around 1600 $cm^{-1}$ indicating that the polyallylamine did not dissolve in the crude. If it had dissolved, a band at around 1570 $cm^{-1}$ would have appeared. The solid was separated from the treated crude by filtration with suction, then washed repeatedly with toluene to free it of oil, then it was dried in vacuo. Infrared examination showed that a band about 1570 $cm^{-1}$ was more intense than in unused polyallylamine, indicating the presence of carboxylate groups combined with the polymer.

EXAMPLE 3

Regeneration of Polyallylamine with $CO_2$ 1.5 g of used polyallylamine with naphthenic acids attached (i.e., polyallylamine partly neutralized with naphthenic acids) to it, isolated and dried as described in Example 2, were put into an autoclave with a capacity of 300 ml. 75 ml of toluene and 5 g of solid carbon dioxide were added, then the autoclave was closed, heated to 80° C. and kept there for 24 hours. After cooling, the solid was separated by filtration and dried in vacuo. Toluene was removed from the filtrate by distillation in a Rotavap. The distillation residue weighed 1.3 g. Examination by infrared showed an intense band at 1708 $cm^{-1}$, due to carboxylic groups, indicating that the acid had been removed from the polyallylamine.

100 mg of distillation residue were analyzed by high-performance liquid chromatography, using aminopropylated silica gel as adsorption material. The analysis showed presence of naphthenic acids ranging in molecular weight from 300 to greater than 750. The average enrichment factor based on starting Bolobo 2/4 was 1.8 g, i.e., the acid content of the distillation residue was 1.8 times the acid content of Bolobo 2/4.

EXAMPLE 4

Regeneration of Polyallylamine Using Ammonia

The reaction apparatus was a stirred glass reactor with a capacity of 150 ml. 1.5 g of crosslinked polyallylamine with naphthenic acids attached to it, isolated and dried as described in Example 2, were put in the reactor. 50 ml of toluene and 141 g of 30 wt % ammonium hydroxide were added, then the mixture was stirred at room temperature for 24 hours. Then the solid was separated by filtration through a frit and washed with toluene. The combined filtrates consisted of two phases. The aqueous phase was discarded. The organic phase, after filtration to remove some solid particles, was evaporated to dryness. The residue weighed 0.27 g. Analysis by high-performance liquid chromatography, using aminopropylated silica gel as adsorbent, showed acids ranging in molecular weight from 250 to greater than 750. The average enrichment factor compared to untreated Bolobo 2/4 was 6.7.

EXAMPLE 5

Neutralization of Bolobo 2/4 Using Crosslinked Polyallylamine

The purpose of this experiment was to obtain polyallylamine loaded with a large amount of naphthenic acids to study its regeneration. The reaction apparatus was a stirred reactor with a capacity of 500 ml and equipped with a reflux condenser. 250 g of Bolobo 2/4, having an acid number of 7.3 mg KOH/g, determined by infrared spectroscopy, were put into the reactor. 2.14 g of crosslinked polyallylamine, prepared as described in Example 1, and 12.5 ml of water were added. The mixture was stirred at 100° C. for 6 hours. After cooling a small amount was centrifuged. The liquid was analyzed by infrared spectroscopy. The band at 1708 $cm^{-1}$, due to carboxyl groups, was 22% less intense than in untreated Bolobo 2/4.

The reactor contents were diluted with 750 ml of toluene and filtered through a frit. The solid was washed repeatedly with toluene and dried in vacuo. It weighed 5 g.

EXAMPLE 6

Regeneration of Polyallylamine Using $CO_2$

The reaction apparatus was a 300 ml autoclave. 1.5 g of polyallylamine partly neutralized with naphthenic acids and isolated as described in Example 5, were put into the autoclave with 75 ml of toluene and 5 g of solid $CO_2$ (dry ice).

The autoclave was rapidly closed and heated at 80° C. with stirring for 24 hours. After cooling, the solid was separated by filtration through a frit. The liquid, consisting mostly of toluene, was evaporated. The evaporation residue weighed 0.44 g. Examination by infrared spectroscopy showed an intense band at 1708 $cm^{-1}$, due to carboxyl groups. Another sample of evaporation residue was analyzed by high-performance liquid chromatography, using aminopropylated silica gel as adsorbent. Naphthenic acids with molecular weights ranging from 250 to greater than 750 were present. The average enrichment factor, based on starting Bolobo 2/4, was 19. The total content of acids was 82%.

EXAMPLE 7

Neutralization of Cyclopentyl-Acetic Acid

The system consisted of 1.8 g of cyclopentyl-acetic acid dissolved in 98.2 g of Tufflo white oil. 10 mls were put into a stirred reactor similar to that used in Example 2. 0.6 g of crosslinked polyallylamine, prepared as described in Example 1, were added. The mixture was stirred at room temperature for 6 hours. Infrared showed no change in the band at 1708 $cm^{-1}$ due to carboxyl groups. 0.5 g of water were added and the mixture was stirred at room temperature overnight. Infrared examination showed that the band at 1708 $cm^{-1}$, due to carboxyl groups, had disappeared.

EXAMPLE 8

Neutralization of Bolobo 2/4

The reaction apparatus was a 200 ml flask, equipped with stirrer and reflux condenser. 50 g of Bolobo 2/4, having a total acid number of 7.3 mg KOH/g, 4.34 g of polyallylamine, crosslinked as described in Example 1, and 2.5 ml of water were put into the flask. Then the flask was brought to 100° C. and kept there for 6 hours. After cooling, the solid was separated by centrifugation. Titration of the oil according to ASTM D-664 gave a total acid number of 2.3 mg KOH/g. Examination by infrared showed that the band a 1708 $cm^{-1}$, attributed to carboxyl groups, was 29% as intense as in untreated Bolobo 2/4.

EXAMPLE 9

Neutralization of Bolobo 2/4

The reaction apparatus was a 200 ml flask, equipped with stirrer and reflux condenser. Into the flask was added 100 g of Bolobo 2/4, having a total acid number of 7.3 mg KOH/g, 4.3 g of crosslinked polyallylamine, prepared as described in Example 1, 5 ml of water. The flask was heated at 100° C. for 6 hours. After cooling, the solid was separated by centrifugation. Titration of the oil according to ASTM D-664 gave a total acid number of 3.1 mg KOH/g.

EXAMPLE 10

Neutralization of Gryphon Crude Oil

The reaction apparatus was a stirred reactor with a capacity of 500 ml and equipped with a reflux condenser. 150 g of Gryphon crude, having an acid number of 4.2 mg KOH/g, determined by infrared spectroscopy, were put into the reactor. 6.4 g of crosslinked polyallylamine, prepared as described in Example 1, and 7.5 ml of water were added. The mixture was stirred at 90° C. for 6 hours. After cooling the mixture was filtered through a coarse glass frit to remove the polyallylamine. The liquid portion was then centrifuged to remove water. Titration of the oil with KOH according to ASTM D-664 gave a total acid number of 0.5 mg KOH/g. Therefore, treatment with polyallyamine had removed 88% of the naphthenic acids.

What is claimed is:

1. A method for decreasing the acidity of an acidic crude oil, comprising: contacting a starting acid-containing crude oil or fraction having a neutralization number of from 0.2 to 10 mg KOH/g with an effective amount of a crosslinked polymeric amine, and wherein the molar ratio of amine groups in the crosslinked polymeric amine to acid groups is from 0.1 to 20 to produce a treated crude oil having a decreased acid content and a crosslinked polymeric amine having acid groups attached thereto, recovering the crosslinked polymeric amine with acid groups attached and regenerating the crosslinked polymeric amine to recover the acids.

2. The method of claim 1 wherein the molar ratio of amine groups to acid groups is from 0.1 to 20.

3. The method of claim 1 wherein the contacting is carried out in the presence of an effective amount of water.

4. The method of claim 1 wherein the crosslinked polymeric amine is selected from the group consisting of polyethylenimine, polyallylamine and polyethylene piperazine.

5. The method of claim 1 wherein the crosslinked polymeric amine is added as a material selected from a solid and a solid-in-liquid slurry.

6. The method of claim 1 wherein the starting crude oil fraction is selected from crude fractions having a boiling point of $650^{+\circ}$ F. ($343^{+\circ}$ C.) and $1050^{+\circ}$ F. ($565^{+\circ}$ C.).

7. The method of claim 1, wherein regenerating the crosslinked polymeric amine is carried out by treatment with $CO_2$.

8. The method of claim 1, wherein regenerating the crosslinked polymeric amine is carried out by treatment with $NH_3$.

9. The method of claim 1, further comprising recycling the regenerated crosslinked polymeric amine to treat additional, acid containing crude.

* * * * *